US008208837B2

(12) United States Patent
Iwamura

(10) Patent No.: US 8,208,837 B2
(45) Date of Patent: Jun. 26, 2012

(54) DEVELOPING DEVICE AND IMAGE FORMING APPARATUS

(75) Inventor: Takuya Iwamura, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 299 days.

(21) Appl. No.: 12/554,342

(22) Filed: Sep. 4, 2009

(65) Prior Publication Data

US 2010/0232838 A1 Sep. 16, 2010

(30) Foreign Application Priority Data

Mar. 12, 2009 (JP) ..... 2009-059357

(51) Int. Cl.
*G03G 15/08* (2006.01)

(52) U.S. Cl. ..... 399/254; 366/319; 399/256

(58) Field of Classification Search ..... 399/254, 399/255, 256, 262, 263; 366/319, 325.3, 366/327.1, 327.3, 81, 88, 133, 321, 322, 366/324, 327.4
See application file for complete search history.

(56) References Cited

U.S. PATENT DOCUMENTS

| | | | | | |
|---|---|---|---|---|---|
| 216,958 | A * | 7/1879 | Hudson | 366/319 |
| 2,756,971 | A * | 7/1956 | Stults | 366/319 |
| 3,652,064 | A * | 3/1972 | Lehnen et al. | 366/88 |
| 4,103,354 | A * | 7/1978 | Gorbatov et al. | 366/88 |
| 4,416,606 | A * | 11/1983 | Sugano et al. | 366/321 |
| 4,449,826 | A * | 5/1984 | Mathis et al. | |
| 4,597,672 | A * | 7/1986 | Neier et al. | 366/321 |
| 5,355,199 | A * | 10/1994 | Bray | 399/256 |
| 5,436,703 | A * | 7/1995 | DeYoung et al. | 399/256 |
| 5,629,758 | A * | 5/1997 | Kageyama et al. | 399/263 |
| 7,228,093 | B2 * | 6/2007 | Sakai et al. | 399/254 |
| 7,313,348 | B2 * | 12/2007 | Hart et al. | 399/256 |
| 7,856,196 | B2 * | 12/2010 | Sakamoto et al. | 399/254 |
| 7,881,638 | B2 * | 2/2011 | Noguchi et al. | 399/254 |
| 2001/0046395 | A1 * | 11/2001 | Ashikari et al. | 399/262 |
| 2003/0185092 | A1 * | 10/2003 | Kimura et al. | 366/319 |
| 2006/0062602 | A1 * | 3/2006 | Hatakeyama et al. | 399/254 |
| 2006/0078354 | A1 * | 4/2006 | Kubota et al. | 399/254 |
| 2007/0041748 | A1 * | 2/2007 | Ikeda | 399/254 |
| 2008/0025762 | A1 * | 1/2008 | Takayama | 399/254 |
| 2009/0180812 | A1 * | 7/2009 | Kunihiro | 399/254 |
| 2011/0150535 | A1 * | 6/2011 | Murauchi et al. | 399/254 |

FOREIGN PATENT DOCUMENTS

| | | |
|---|---|---|
| JP | 09-043962 | 2/1997 |
| JP | 2002-148915 | 5/2002 |
| JP | 2002-278232 | 9/2002 |
| JP | 2005-156954 | 6/2005 |
| JP | 2006-106601 | 4/2006 |
| JP | 2008-250290 | 10/2008 |

* cited by examiner

*Primary Examiner* — Susan Lee
(74) *Attorney, Agent, or Firm* — Morgan, Lewis & Bockius LLP

(57) ABSTRACT

A developing device includes a conveyance path, a conveyance member, a return path, and a pre-agitation region. The conveyance path conveys a toner while agitating the toner. The conveyance member has a rotational shaft, which is rotatably disposed along an upstream end to a downstream end of the conveyance path, and conveys the toner toward the downstream end due to rotation of the rotational shaft. The return path communicates with the downstream end and an intermediate portion of the conveyance path, thereby forming a circulation path, and returns the toner from the downstream end to the intermediate portion. The pre-agitation region is formed at the upstream end side, extending from the intermediate portion and outside the circulation path, and pre-agitates the toner to be conveyed to the circulation path.

6 Claims, 8 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2009-059357 filed on Mar. 12, 2009.

BACKGROUND

1. Technical Field

The present invention relates to a developing device and an image forming apparatus.

2. Related Art

There have been proposed a developing device having a variable dispersion force for dispersing a supplied toner in a developer.

SUMMARY

An aspect of the invention is a developing device including: a conveyance path that conveys a toner while agitating the toner; a conveyance member, having a rotational shaft, which is rotatably disposed along an upstream end to a downstream end of the conveyance path, the conveyance member conveying the toner toward the downstream end due to rotation of the rotational shaft; a return path that communicates with the downstream end and an intermediate portion of the conveyance path thereby forming a circulation path, the return path returning the toner from the downstream end to the intermediate portion; and a pre-agitation region formed at the upstream end side, extending from the intermediate portion and outside the circulation path, the pre-agitation region pre-agitating the toner to be conveyed to the circulation path.

BRIEF DESCRIPTION OF THE DRAWINGS

Exemplary embodiments of the present invention will be described in detail based on the following figures, wherein.

DETAILED DESCRIPTION

Hereinafter, exemplary embodiments will be described with reference to the drawings.

Overall Structure of Image Forming Apparatus

Figure 1:
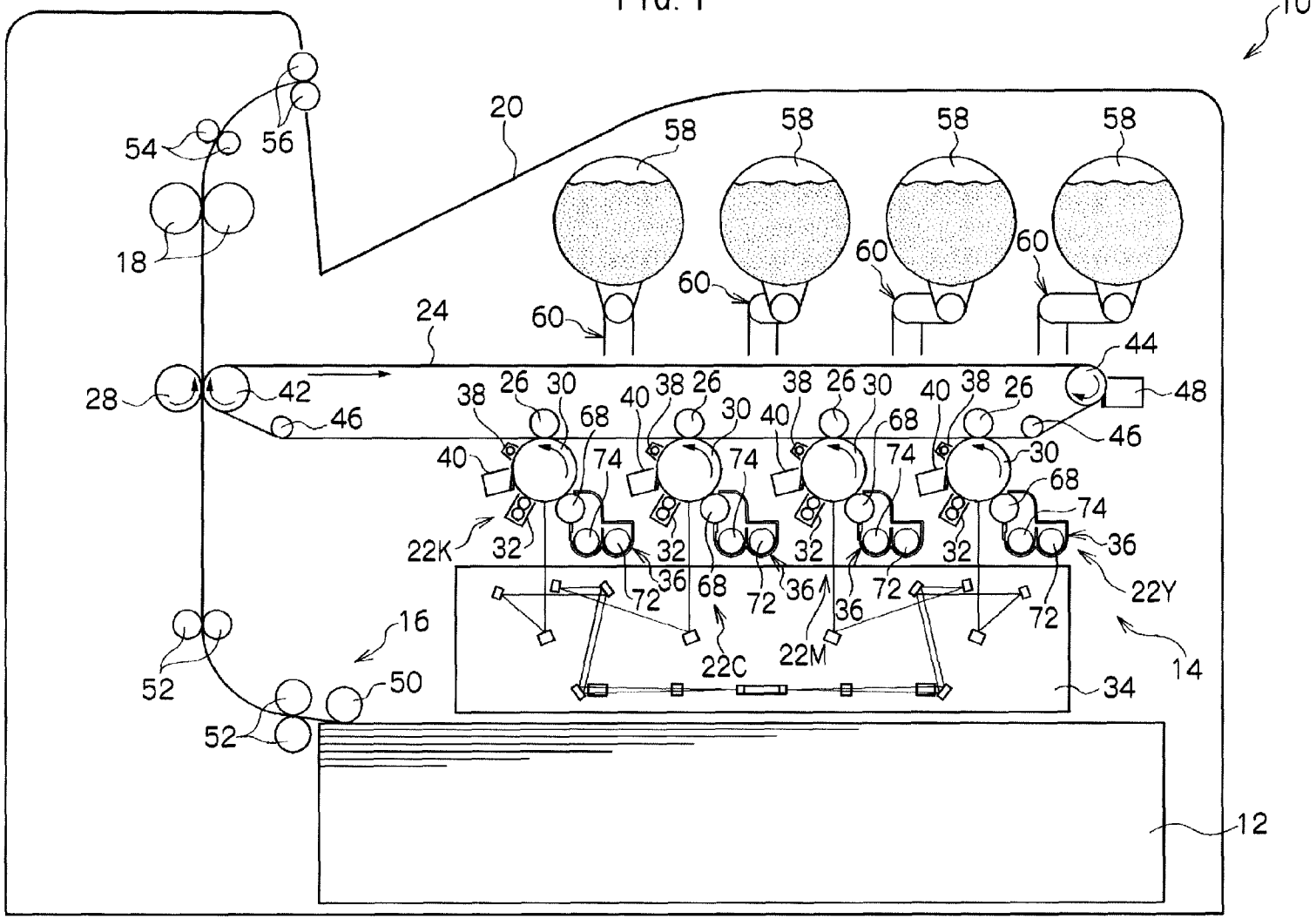
FIG. 1 is a schematic view showing an overall structure of an image forming apparatus according to an exemplary embodiment.

Firstly, the overall structure of an image forming apparatus according to the exemplary embodiment will be described. FIG. 1 is a schematic view showing the overall structure of the image forming apparatus 10 according to the exemplary embodiment.

The image forming apparatus 10 has, as shown in FIG. 1, a storage 12 that stores a recording medium P such as paper sheets, an image forming section 14 that forms a toner image on the recording medium P, a conveyance unit 16 that conveys the recording medium P from the storage 12 to the image forming section 14, a fixing device 18 that fixes the toner image formed by the image forming section 14 to the recording medium P, and an discharging unit 20 to which the recording medium P on which the toner image is fixed by the fixing device 18 is discharged.

The image forming section 14 has image forming units 22Y, 22M, 22C and 22K, an intermediate transfer belt 24, primary transfer rolls 26, and a secondary transfer roll 28. The image forming units 22Y, 22M, 22C and 22K form toner images of yellow (Y), magenta (M), cyan (C) and black (K), respectively. The intermediate transfer belt 24 is an example of an intermediate transfer body onto which the toner images formed by the image forming units 22Y, 22M, 22C and 22K are transferred. Each of the primary transfer rolls 26 is an example of a primary transfer member that transfers the toner image formed by the image forming unit 22Y, 22M, 22C or 22K to the intermediate transfer belt 24. The secondary transfer roll 28 is an example of a secondary transfer member that transfers the toner image transferred on the intermediate transfer belt 24 to the recording medium P.

The image forming units 22Y, 22M, 22C and 22K respectively have photoconductor drums 30 rotating in one direction (counterclockwise direction in FIG. 1) as image holdings members on which electrostatic latent images are formed on the surfaces thereof.

Around each of the photoconductor drums 30, there are provided a charging device 32 that charges the surface of the photoconductor drum 30, an exposure device 34 that exposes the surface of the charged photoconductor drum 30 to light to form an electrostatic latent image on the surface of the photoconductor drum 30, a developing device 36 that develops the electrostatic latent image formed on the surface of the photoconductor drum 30 to form a toner image, a discharging (neutralization) device 38 that discharges or neutralizes the surface of the photoconductor drum 30 after the toner image is transferred onto the intermediate transfer belt 24, and a removing device 40 that removes the toner remaining on the surface of the photoconductor drum 30 after the toner image is transferred onto the intermediate transfer belt 24. These components are provided in this order from the upstream side in the rotational direction of the photoconductor drum 30.

Toner storages 58 that respectively store toners are provided above the intermediate transfer belt 24. The toner storages 58 are provided for respective image forming units 22Y, 22M, 22C and 22K. Between each of the toner storage 58 and the corresponding developing device 36, a toner conveyance device 60 that conveys the toner from the toner storage 58 to the developing device 36 is provided.

The developing device 36 is structured to perform development by using a developer containing a carrier and a toner. When the toner in the developer of the developing device 36 is consumed and goes short, the toner conveyance device 60 supplies the toner from the toner storage 58 to the corresponding developing device 36. A specific structure of the developing device 36 will be described later.

The intermediate belt 24 is supported by an opposing roll 42 facing the secondary transfer roll 28, a driving roll 44 and a supporting roll 46 and circulates in one direction (clockwise direction in FIG. 1) while keeping in contact with the photoconductor drums 30.

A toner removing unit 48 that removes the toner remaining on the intermediate transfer belt 24 is provided on the intermediate transfer belt 24.

Each primary transfer roll 26 faces the corresponding photoconductor drum 30 with the intermediate transfer belt 24 interposed therebetween. Between each of the primary transfer rolls 26 and the corresponding photoconductor drums 30 is a primary transfer position for primarily transferring the toner image on the photoconductor drum 30 to the intermediate transfer belt 24. At the primary transfer position, each of the primary transfer rolls 26 transfers the toner image on the corresponding photoconductor drum 30 to the intermediate transfer belt 24 by a pressing force and an electrostatic force.

The secondary transfer roll 28 faces the opposing roll 42 with the intermediate transfer belt 24 interposed therebetween. Between the secondary transfer roll 28 and the opposing roll 42 is a secondary transfer position for secondarily transferring the toner image on the intermediate transfer belt 24 to the recording medium P.

The conveyance unit 16 has a feed-out roll 50 for feeding out the recording medium P stored in the storage 12 and pairs of conveyance rolls 52 for holding and carrying the recording medium P fed out by the feed-out roll 50 to the second transfer position.

The fixing device 18 is disposed downstream of the secondary transfer position in the conveyance direction and fixes the toner image transferred at the secondary transfer position to the recording medium P.

Downstream of the fixing device 18 in the conveyance direction, a pair of conveyance rolls 54 that holds and carries the recording medium P and a pair of ejection rolls 56 that eject the recording medium P to the discharge unit 20.

Next, the image forming operation of the image forming apparatus according to the exemplary embodiment will be described.

In the image forming apparatus 10, when an image is formed on a recording medium P, the recording medium P fed out from the storage 12 is firstly sent to the secondary transfer position by the conveyance roll pairs 52.

Meanwhile, toner images of respective colors formed by the image forming units 22Y, 22M, 22C and 22K are superimposed one upon another to form a color image on the intermediate transfer belt 24. The color image formed on the intermediate transfer belt 24 is transferred to the recording medium P which is conveyed to the secondary transfer position.

The recording medium P on which the toner image is transferred is conveyed toward the fixing device 18, which fixes the transferred toner image. The recording medium P with the toner image fixed thereon is ejected by the ejection roll pair 56 to the discharge unit 20. A series of the image forming operation steps is performed in this way.

Structure of Developing Device

Figure 2:
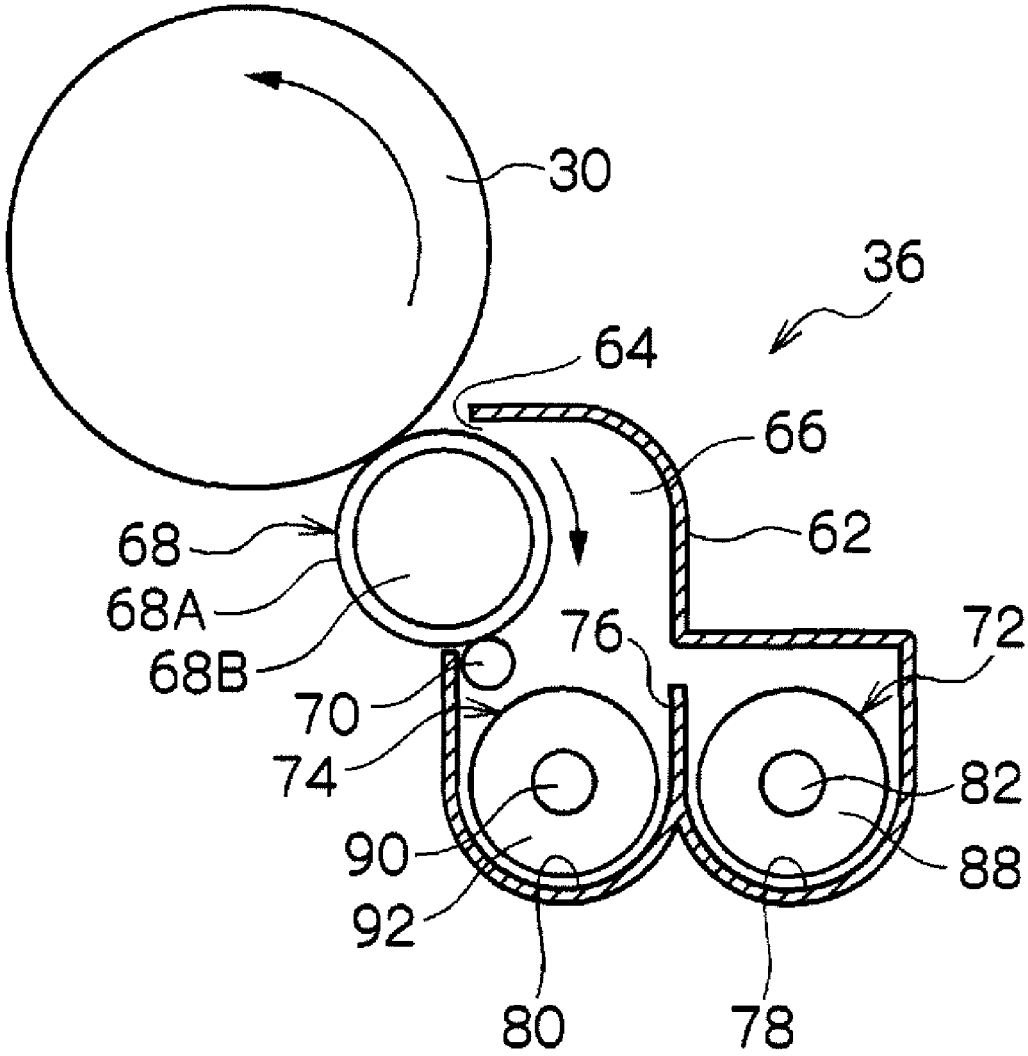
FIG. 2 is a schematic view showing a structure of a developing device according to the exemplary embodiment.

Next, description is made regarding the structure of the developing device according to the exemplary embodiment. FIG. 2 is a schematic view showing the structure of the developing device and FIG. 3 is a partial cross-sectional view of the developing device seen from the above.

Figure 3:
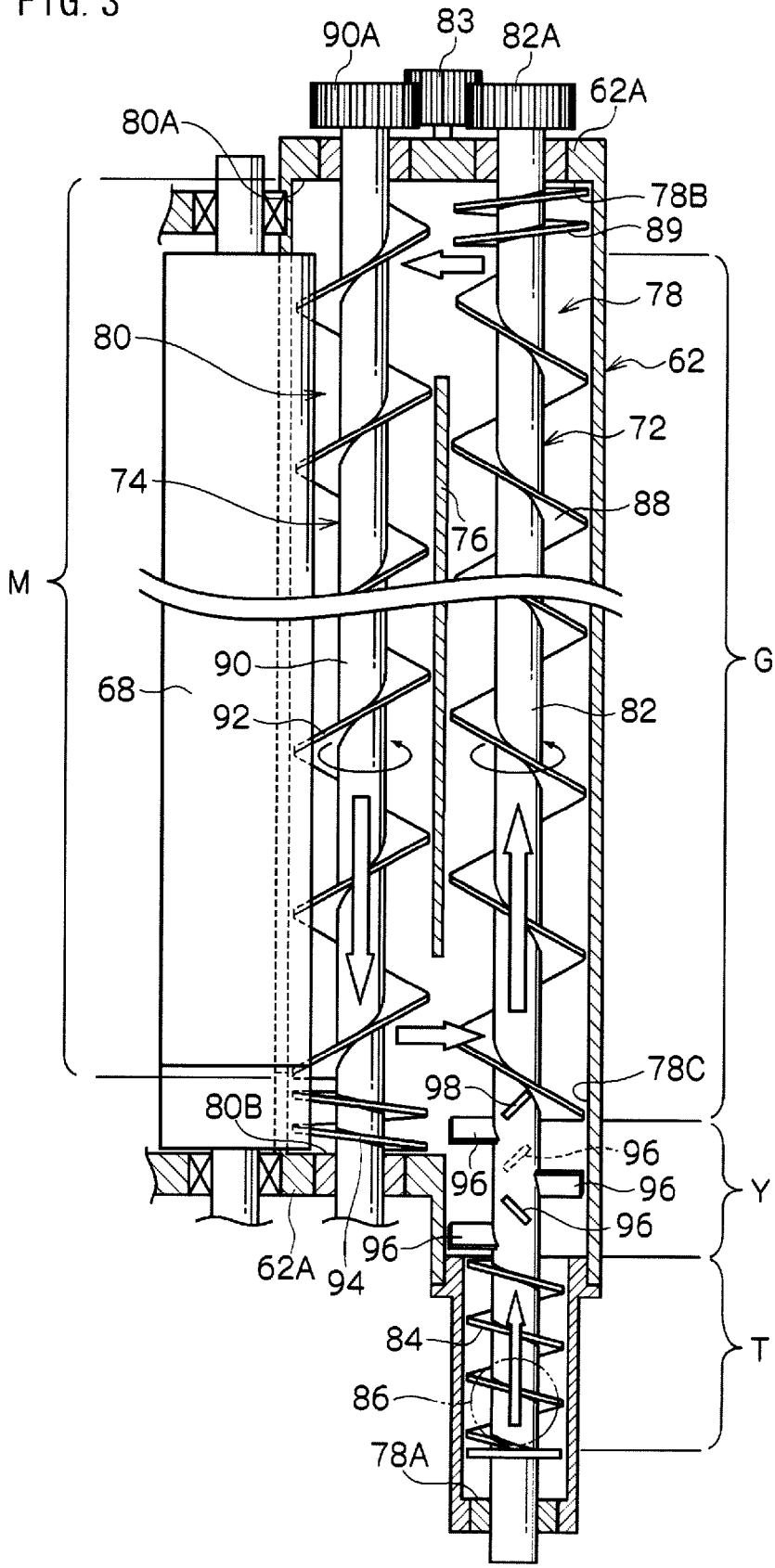
FIG. 3 is a partial cross-sectional view of the developing device seen from the above.

As shown in FIGS. 2 and 3, the developing device 36 has a housing 62 for accommodating several structural components. The housing 62 has a developer storage chamber (developer chamber) 66 that stores a developer containing toners and carriers.

Further, an opening 64 which is open toward the photoconductor drum 30 is formed in the housing 62. A developing roll 68 is provided as a developer holding member in the housing 62 in such a manner that the developing roll 68 is partially exposed from the opening 64. This developing roll 68 has a cylindrical sleeve 68A having conductivity and being rotatably supported by the housing 62 and a cylindrical-column-shaped magnet roll 68B fixed to the housing 62.

A gear (not shown) is fixed to an end of the rotational axis of the sleeve 68A, and a rotational force from a motor (not shown) is conveyed to the gear, whereby the sleeve 68A rotates via the gear.

At a position opposing to the sleeve 68A, a regulating member 70 for regulating an amount of the developer on the sleeve 68A is disposed.

With this structure, the developing roll 68 absorbs the carriers contained in the developer by magnetic force, forms a magnetic brush of the developer on the surface thereof, and conveys the developer to the position facing the photoconductor drum 30 while the amount of the developer is regulated by the regulating member 70. Then, an electrostatic latent image formed on the photoconductor drum 30 is visualized as a toner image by the developer on the developing roll 68.

Further, as shown in FIG. 3, a conveyance path 78 which extends in the axial direction of the developing roll 68 and which is for conveying a toner while agitating the toner is provided in the housing 62. This conveyance path 78 has an end 78A located upstream of the conveyance direction and an end 78B located downstream of the conveyance direction. The end 78A extends out from one axial end of the developing roll 68 (lower end in FIG. 3), and the end 78B extends out from the other axial end of the developing roll 68 (upper end in FIG. 3), i.e., the ends 78A and 78B extend beyond the respective ends of the developing roll 68 in the axial direction.

In the conveyance path 78, a conveyance member 72 capable of carrying the toners toward the downstream end 78B is disposed along the axial direction of the developing roll 68 from the upstream end 78A to the downstream end 78B.

This conveyance member 72 has a rotational shaft 82 which is rotatable and disposed along the upstream end 78A of the conveyance path 78 to the downstream end 78B thereof. The rotational shaft 82 is rotatably supported by side walls 62A of the housing 62. A gear 82A is fixed at an end of the rotational shaft 82 and a rotational force from a motor (not shown) is conveyed via a gear 83 and the gear 82A whereby the rotational shaft 82 rotates.

This rotational shaft 82 has a spiral member 84 which is provided spirally on and around the rotational shaft 82 in the upstream end 78A side of the conveyance path 78 and is capable of conveying the toner from the upstream side to the downstream side due to the rotation of the rotational shaft 82.

The conveyance path 78 has a toner conveyance region T at a portion where the spiral member 84 is provided, in which the toner is conveyed by the spiral member 84. In the toner conveyance region T, an inlet 86, through which the toner conveyed from the toner storage 58 to the developing device 36 by the toner conveyer 60 is flow into the conveyance path 78, is formed in the housing 62.

The rotational shaft 82 is provided with a spiral member 88 formed on and around the rotational shaft 82 at the downstream side of the toner conveyance region T in the conveyance direction (i.e., downstream end 78B side of the conveyance path 78). The spiral member 88 is capable of conveying the toner from the upstream side to the downstream side by the rotation of the rotational shaft 82. The spiral member 88 is provided on the rotational shaft 82 in a range extending from the intermediate portion 78C of the conveyance path 78 to the downstream end 78B.

In the conveyance path 78, a developer conveyance region G is formed in a portion where the spiral member 88 is formed, and where the developer is conveyed by the spiral member 88. In the developer conveyance region G, the toner and the carrier are conveyed while being agitated.

Between the toner conveyance region T and the developer conveyance region G, a pre-agitation region Y for performing pre-agitation of the toner is formed.

The pre-agitation region Y is formed continuously from the intermediate portion 78C of the conveyance path 78 to the upstream end 78A side of the conveyance path 78. Although the pre-agitation region Y communicates with the developer conveyance region G, it is formed outside of the circulation path formed by a developer return region M, which is described later, and the developer conveyance region G.

The rotational shaft 82 has a spiral member 89 which is formed on and around the rotational shaft 82 in the downstream side of the spiral member 88 in the conveyance direction, and in which the winding direction thereof is reverse to those of the spiral members 84 and 88. The spiral member 89 is capable of conveying the toner from the downstream side to the upstream side by the rotation of the rotational shaft 82.

The housing 62 has a return path 80 extending along the developing roll 68. The return path 80 is connected to the downstream end 78B and the intermediate portion 78C of the conveyance path 78 and designed to return the toner from the downstream end 78B of the conveyance path 78 to the intermediate portion 78C.

The return path 80 has an upstream end 80A at the return directional upstream side and a lower end 80B at the return directional downstream side. The upstream end 80A reaches further outside than (extends beyond) one axial end of the developing roll 68 (the upper end in FIG. 3), and the downstream end 80B substantially reaches the other axial end of the developing roll 68 (the lower end in FIG. 3).

As shown in FIG. 2, the return path 80 and the conveyance path 78 are arranged in parallel with each other in a horizontal direction below the developing roll 68. Further, when seen from the above, the return path 80 is overlapped with the developing roll 68, and the conveyance path 78 is not overlapped with the developing roll 68. Further, the return path 80 is disposed at a side nearer to the developing roll 68 (the left side in FIGS. 2 and 3) and the conveyance path 78 is disposed at a side distant from the developing roll 68 (the right side in FIGS. 2 and 3).

Between the return path 80 and the conveyance path 78, there is provided a partition wall 76 which extends in the axial direction of the developing roll 68, and which is designed to partition the return path 80 and the conveyance path 78. The return path 80 and The conveyance path 78 communicate with each other at respective longitudinal ends of the partition wall 76 and the side walls 62A of the housing 62.

The return path 80 has a conveyance member 74 that extends in a region from the upstream end 80A to the downstream end 80B, and that is capable of conveying the toner toward the downstream end 80B along the axial direction of the developing roll 68.

The conveyance member 74 has a rotational shaft 90 rotatably disposed along the upstream end 80A of the return path 80 to the downstream end 80B thereof. The rotational shaft 90 is rotatably supported at the side walls 62A of the housing 62. A gear 90A is fixed at an end of the rotational shaft 90 and a rotational force from a motor (not shown) is conveyed via the gears 83 and 90A whereby the rotational shaft 90 rotates.

The rotational shaft 90 has a spiral member 92 formed on and around the rotational shaft 90 at the upstream end 80A side of the return path 80. The spiral member 92 is capable of conveying the toner from the upstream side to the downstream side of the return path 80 by rotation of the rotational shaft 90.

The return path 80 has a developer return region M which is formed in a portion where the spiral member 92 is formed, and which is designed to return the developer to the conveyance path 78. The developer return region M and the developer conveyance region G form a circulation path that circulates the developer.

The rotational shaft 90 has a spiral member 94 formed on and around the rotational shaft 90 at a portion downstream in the return-direction than the spiral member 92. The winding direction of the spiral member 94 is reverse to that of the spiral member 92 and the spiral member 94 is designed to convey the toner from the downstream side to the upstream side by rotation of the rotational shaft 90.

Figure 4:
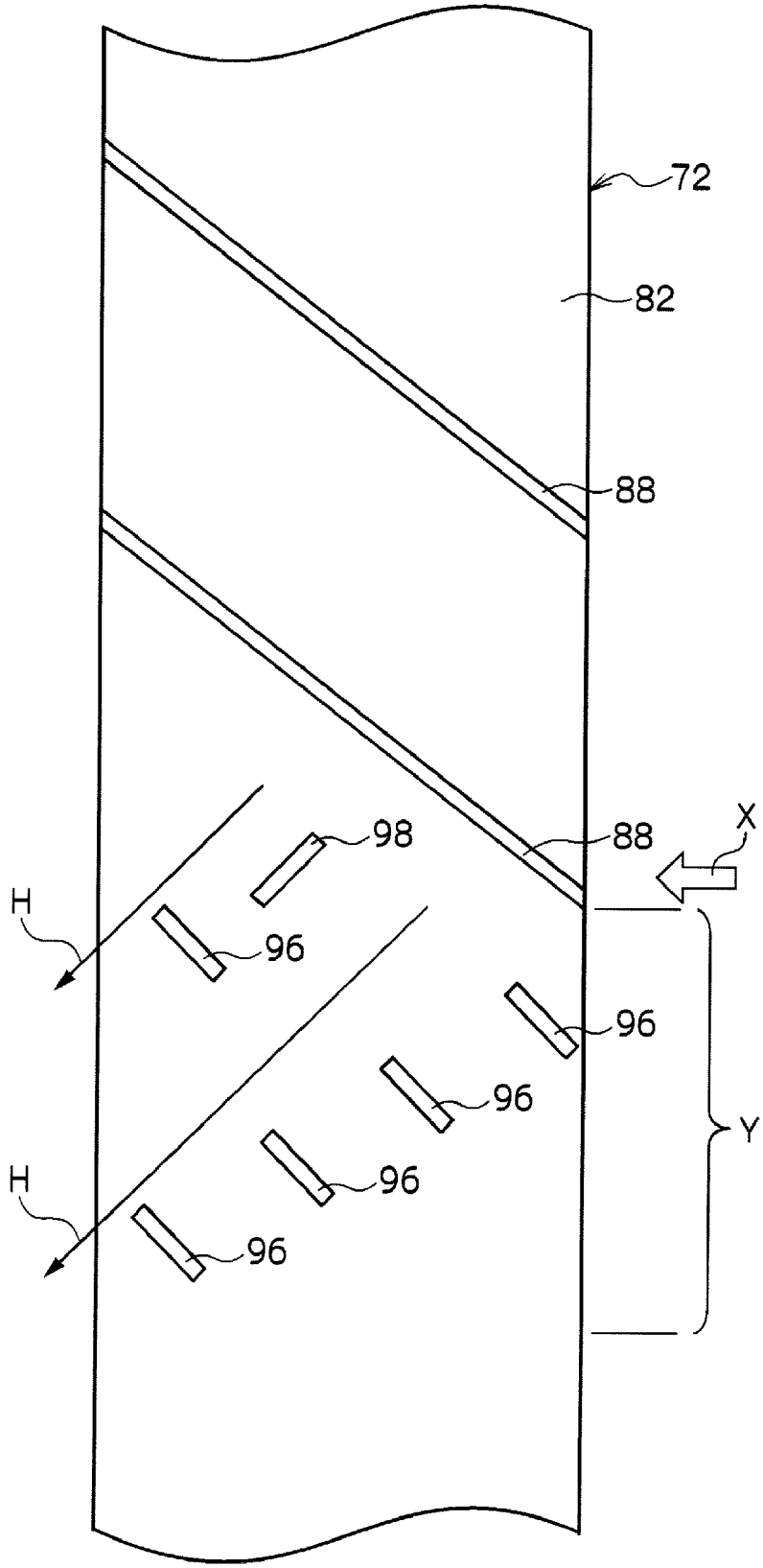
FIG. 4 is a developed view of a rotational shaft of a conveyance member according to the exemplary embodiment.
Figure 5:
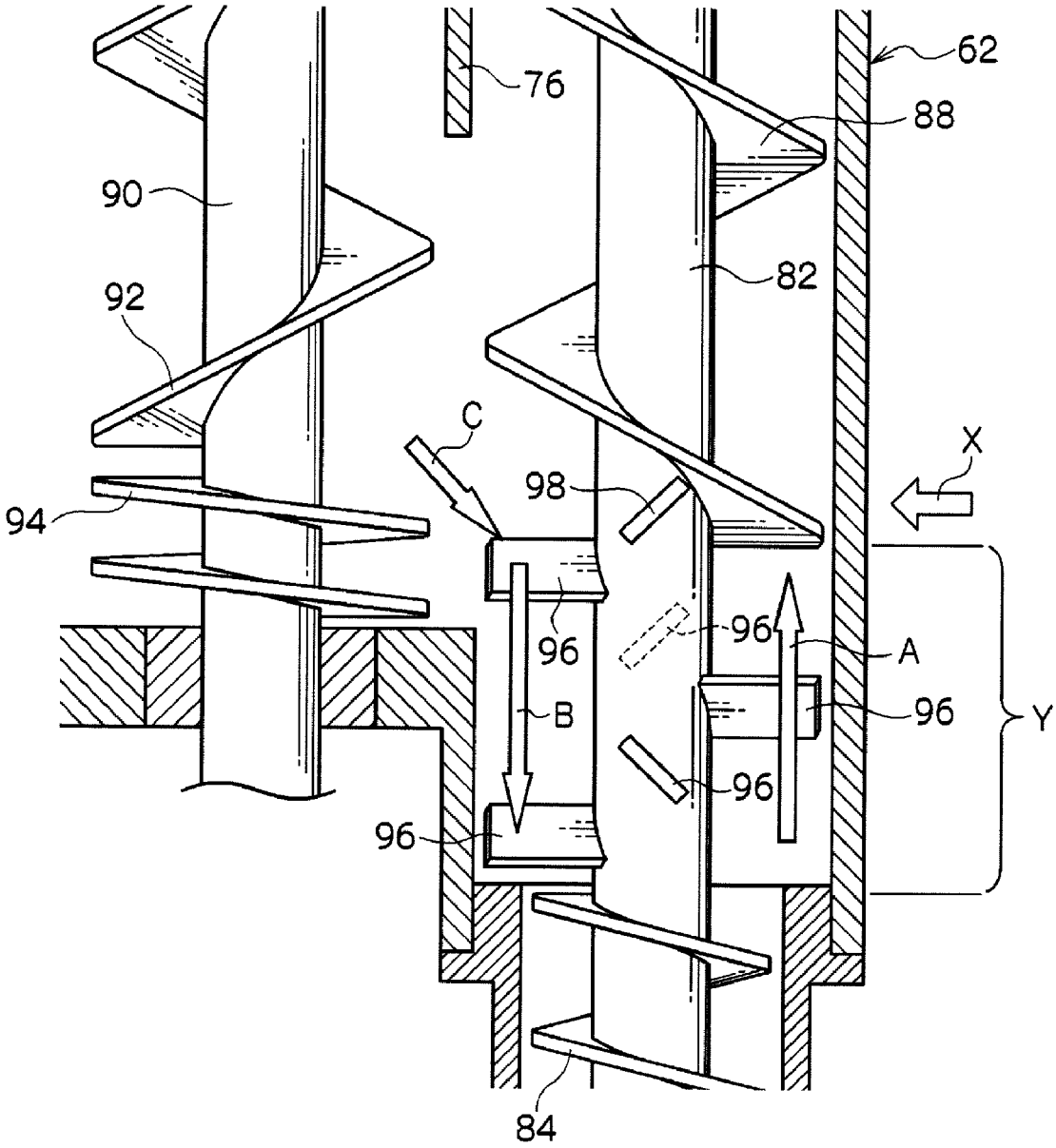
FIG. 5 is an enlarged view showing a pre-agitation region according to the exemplary embodiment in an enlarged manner.

As shown in FIGS. 4 and 5, the rotational shaft 82 has plural first wing members (first projections) 96 provided at a portion of the circumference of the rotational shaft 82 in the pre-agitation region Y. In the exemplary embodiment, four first wing members 96 are provided.

Each first wing member 96 is formed in a plate shape projecting out in the radial direction from the rotational shaft 82. Further, each first wing member 96 is disposed at an angle in a direction which can convey the toner from the upstream end 78A side of the conveyance path 78 toward the intermediate portion 78C side by the rotation of the rotational shaft 82.

In addition, the rotational shaft 82 has a second wing member (second projection) 98 formed at a portion of the circumference of the rotational shaft 82 in the developer conveyance region G (in the intermediate portion 78C of the conveyance path 78). The second wing member 98 overlaps the spiral member 88 when seen from the radial direction of the rotational shaft 82 (in the direction of arrow X of FIGS. 4 and 5). In the exemplary embodiment, one second wing member 98 is provided.

The second wing member 98 is formed in a plate shape projecting out in the radial direction from the rotational shaft 82. Further, the second wing member 98 is disposed at an angle in a direction which can convey the toner from the intermediate portion 78C of the conveyance path 78 toward the upstream end 78A side by the rotation of the rotational shaft 82.

The arrangement direction (the direction H in FIG. 4) of the plural first wing members 96 and the second wing member 98 are set to be in a spiral direction which is reverse to the spiral direction of the spiral members 84 and 88.

Each of the plurality of first wing members 96 is disposed at an angle which crosses the reverse direction of the spiral direction. The second wing member 98 is disposed at an angle which crosses the spiral direction.

Operation of Developing Device

Next an operation of the developing device according to the exemplary embodiment will be described.

In the developing device 36, a developer containing a toner and a carrier circulates in the circulation path formed by the developer conveyance region G and the developer return region M. The developer circulating in the circulation path is attracted to the developing roll 68 in the developer return region M and the toner is supplied to the photoconductor drum 30 for image formation.

After the toner is consumed and separated from the developing roll 68, the developer fed for image formation is returned to the developer return region M. The developer returned to the developer return region M is then returned to the developer conveyance region G of the conveyed path 78 by the conveyance member 74.

When the toner in the developer is consumed and goes short, a toner is fed from the corresponding toner storage 58 to the developing device 36 by the toner conveyer 60. The toner fed to the developing roll 68 flows into the toner conveyance region T of the conveyance path 78 via the inlet 86. The toner flowed in the toner conveyance region T is conveyed to the pre-agitation region Y by the spiral member 84 due to the rotation of the rotational shaft 82.

The toner conveyed to the pre-agitation region Y is subjected to pre-agitation and then conveyed to the developer conveyance region G by the first wing members 96 due to the rotation of the rotational shaft 82 and is fed into the circulation path. The toner fed into the developer conveyance region G is conveyed and circulates in the circulation path while being agitated with the developer of which the toner is consumed.

Here, movements of the toner in the pre-agitation region Y will be described. In the structure of the exemplary embodiment, as shown in FIG. 5, since the developer conveyance region G in the circulation path and the pre-agitation region Y are communicated with each other, a part of the developer circulating in the circulation path flows into the pre-agitation region Y (refer to arrow C in FIG. 5).

Further, a part of the developer which is circulating is conveyed by the second wing member 98 toward the developer conveyance region G, whereby flow of the developer into the pre-agitation region Y is promoted.

The developer flowed into the pre-agitation region Y is conveyed toward the circulation path while being mixed and agitated with the supplied toner by the first wing members 96.

It is expected that due to the action of the force of the first wing members 96 conveying the toner toward the circulation path and the force of the second wing member 98 drawing the developer from the circulation path, wiggling of the toner and the developer in the axial direction is generated at the intermediate portion 78C, thereby agitating the toner and the developer.

Then, the developer, mixed and agitated in the pre-agitation region Y, is fed toward the first wing members 96 and progressively conveyed along the wall surface at the arrow A side. At this time, since the first wing members 96 are arranged in a direction of spiral which is the reverse direction to the direction of spiral of the spiral member 88, in general, a conveyance action by the reverse spiral members is performed and the developer in the pre-agitation region Y is conveyed together with the fed developer along the wall surface at the arrow B side. In this way, a small developer circulation is generated in the pre-agitation region Y. Hence, the fed toner is mixed and sufficiently agitated with the developer, and the agitated developer is then fed to the circulation path via the intermediate portion 78C.

Figure 6:
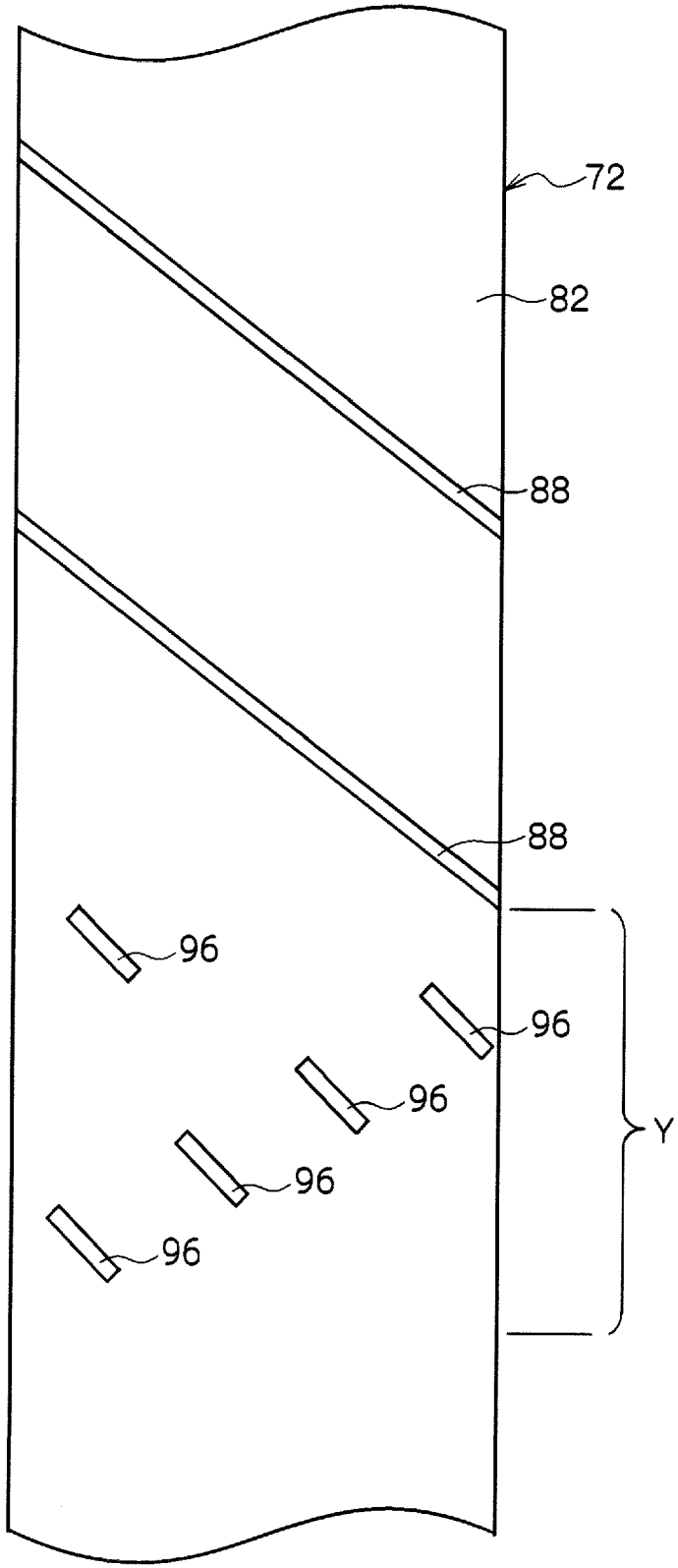
FIG. 6 is a developed view showing a modification in which a second wing member is omitted.

In the exemplary embodiment, the second wing member 98 is provided in the rotational shaft 82. However, the second wing member 98 may be omitted as shown in FIG. 6 as long as the developer circulation can be generated in the pre-agitation region Y.

Figure 7:
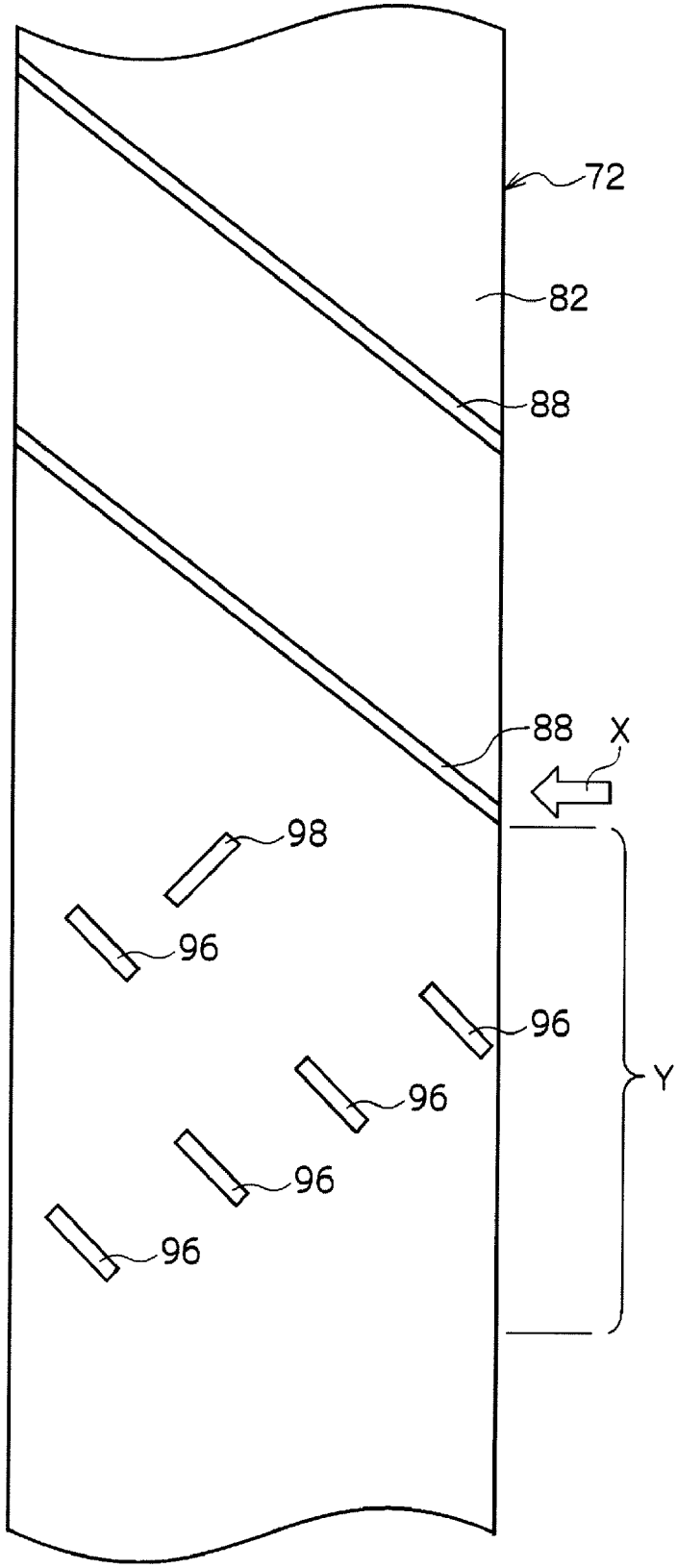
FIG. 7 is a developed view showing a modification in which a first wing members and the second wing member are arranged in a different manner.

Further, in the exemplary embodiment, the second wing member 98 is provided so as to overlap with the spiral member 88 when seen from the radial direction of the rotational shaft 82 (in the direction of the arrow X in FIGS. 4 and 5). However, the second wing member 98 and the spiral member 88 may not be overlapped with each other as shown in FIG. 7 as long as the developer circulation can be generated in the pre-agitation region Y.

Figure 8:
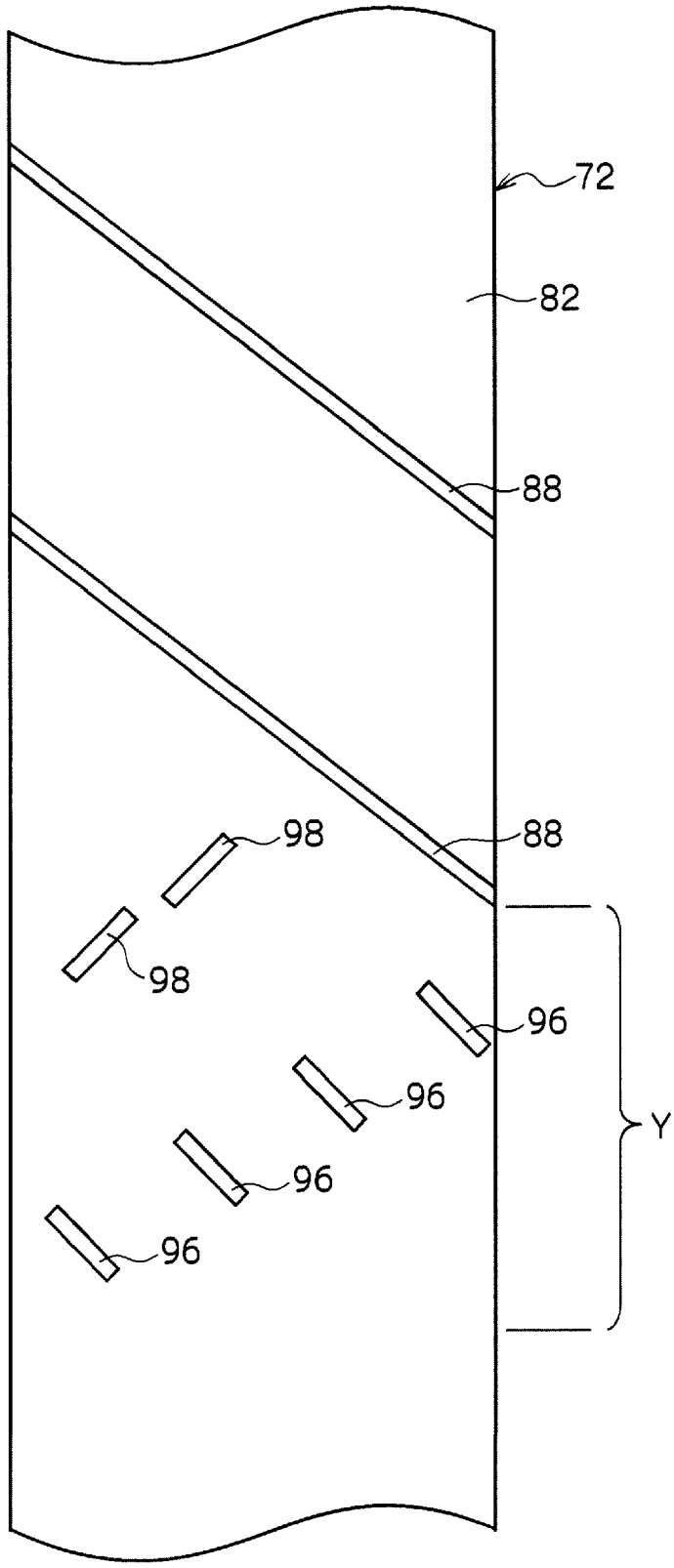
FIG. 8 is a developed view showing a modification where the first wing members and the second wing member are arranged in a yet different manner.

Furthermore, in the exemplary embodiment, five first wing members 96 and one second wing member 98 are provided. However, the numbers of first wing members 96 and the second wing members 98 may be determined as desired and, for example, four first wing members 96 and two second wing members 98 may be provided as shown in FIG. 8.

The embodiments are not limited to the above-described exemplary embodiment and various modifications, alterations and/or improvements are possible.

What is claimed is:

1. A developing device comprising:

a developing roller;

a conveyance path that conveys a developer, and has a first region at an upstream side in a conveyance direction of the developer, and a second region at a downstream side in the conveyance direction;

a return path that communicates with the conveyance path at an upstream end portion and downstream end portion of the second region of the conveyance path, the return path disposed closer to the developing roller than the conveyance path;

a first conveyance member having a rotational shaft that is rotatably disposed along the conveyance path, and conveys the developer from the first region to the second region and further conveys the developer from the upstream end portion to the downstream end portion of the second region, a spiral portion that is provided on the rotating shaft of the first conveyance member, and a plurality of first wing members that is projected from a part of the rotational shaft of the first conveyance member in the first region, the plurality of first wing members being spirally arranged in a reverse direction to a spiral direction of the spiral portion, each of the plurality of first wing members being disposed at an angle which crosses the reverse direction; and a second conveyance member, having a rotating shaft that is rotatably disposed along the return path, the second conveyance member conveying the developer from the downstream end portion to the upstream end portion of the second region so as to circulate the developer between the conveyance path and the return path.

2. The developing device of claim 1, wherein the spiral portion is not provided on the first conveyance member in the first region.

3. An image forming apparatus comprising:

the developing device of claim 1; and an image holding member that holds an electrostatic latent image formed on a surface thereof which is to be developed by the developing device.

4. A developing device comprising:

a developing roller;

a conveyance path that conveys a developer, and has a first region at an upstream side in a conveyance direction of the developer, and a second region at a downstream side in the conveyance direction;

a return path that communicates with the conveyance path at an upstream end portion and a downstream end portion of the second region of the conveyance path, the return path disposed closer to the developing roller than the conveyance path;

a first conveyance member having a rotational shaft that is rotatably disposed along the conveyance path, and conveys the developer from the first region to the second region and further conveys the developer from the upstream end portion to the downstream end portion of the second region, a spiral portion that is provided on the rotating shaft of the first conveyance member, a plurality of first wing members that is projected from a part of the rotational shaft of the first conveyance member in the first region, the plurality of first wing members being spirally arranged in a reverse direction to a spiral direction of the spiral portion, each of the plurality of first wing members being disposed at an angle which crosses the reverse direction, and a second wing member that is projected from a part of the rotational shaft of the first conveyance member in the upstream end portion of the second region, the second wing member disposed at an angle which crosses the spiral direction; and a second conveyance member, having a rotating shaft that is rotatably disposed along the return path, the second conveyance member conveying the developer from the downstream end portion to the upstream end portion of the second region so as to circulate the developer between the conveyance path and the return path.

5. The developing device of claim 4, wherein the spiral portion is not provided on the first conveyance member in the first region.

6. An image forming apparatus comprising:

the developing device of claim 4; and an image holding member that holds an electrostatic latent image formed on a surface thereof which is to be developed by the developing device.

* * * * *